US007757462B2

(12) United States Patent
Harrison et al.

(10) Patent No.: US 7,757,462 B2
(45) Date of Patent: Jul. 20, 2010

(54) MULTI-LAYER FRANKFURTER LOADING METHOD

(75) Inventors: William L. Harrison, West Chester, OH (US); Michael F. Showler, Loveland, OH (US)

(73) Assignee: F.R. Drake Company, Waynesboro, VA (US)

( * ) Notice: Subject to any disclaimer, the term of this patent is extended or adjusted under 35 U.S.C. 154(b) by 151 days.

(21) Appl. No.: 12/192,487

(22) Filed: Aug. 15, 2008

(65) Prior Publication Data

US 2008/0305225 A1 Dec. 11, 2008

Related U.S. Application Data

(62) Division of application No. 10/730,969, filed on Dec. 9, 2003, now abandoned.

(60) Provisional application No. 60/431,850, filed on Dec. 9, 2002.

(51) Int. Cl.
*B65B 35/50* (2006.01)

(52) U.S. Cl. ..... 53/447; 53/148; 53/236; 53/444; 53/537; 53/540; 198/418.6; 198/419.3

(58) Field of Classification Search ..... 53/148, 53/153, 236, 247, 443, 444, 447, 473, 475, 53/531, 537, 539, 540, 542; 198/418.6, 419.3
See application file for complete search history.

(56) References Cited

U.S. PATENT DOCUMENTS 3,180,066 A * 4/1965 Mahaffy et al. ..... 53/52
3,238,695 A * 3/1966 Dugle et al. ..... 53/500
3,250,372 A * 5/1966 Wagner et al. ..... 198/396
3,279,147 A * 10/1966 Garapolo ..... 53/252
3,445,986 A * 5/1969 Godet ..... 53/148
3,498,022 A * 3/1970 Godet ..... 53/149
4,048,784 A * 9/1977 Toby ..... 53/77
4,709,535 A * 12/1987 Mahaffy et al. ..... 53/473
4,733,518 A * 3/1988 Griesdorn ..... 53/444

* cited by examiner

*Primary Examiner*—Thanh K Truong
(74) *Attorney, Agent, or Firm*—Berenato & White, LLC

(57) ABSTRACT

A system and method for multi-layer loading of food items such as frankfurters in a receptacle includes the steps of displacing groupings of frankfurters along a staging area, allowing the frankfurters to drop downwardly by gravity to an accumulation and storage area until at least two layers of frankfurters are accumulated and allowing the double layer of frankfurters to drop downwardly into a packing receptacle in a packing area. The method of the invention is accomplished by providing a lug chain with lugs spaced to group frankfurters in desired groupings on the staging area, a first set of displaceable supports positioned below the lug chain to allow a layer of frankfurters to fall downwardly by gravity to the accumulation and storage area, a second set of displaceable supports positioned in the accumulation and storage area to allow at least two layers of frankfurters to be accumulated, then actuated to allow the two layers to drop vertically downwardly to a collection receptacle in the packing area, and a pair of tucking flaps that are actuated to an open position to allow two layers of frankfurters to fall downwardly therebetween and to a closed position in which frankfurters are forced by contact therewith into appropriate alignment within the receptacle.

9 Claims, 5 Drawing Sheets

MULTI-LAYER FRANKFURTER LOADING METHOD

This application is a divisional of application Ser. No. 10/730,969, filed Dec. 9, 2003, now abandoned which claims the benefit of provisional application Ser. No. 60/431,850 filed Dec. 9, 2002.

BACKGROUND

The present invention relates to product handling systems and, more particularly, to food product handling systems that receive individual product items, accumulate the items into groups and transfer the groups to a packing receptacle.

Systems for packing food product items, and in particular food product items of uniform size and shape, typically consist of a bin or other large container for receiving the individual food items, a device for receiving the food items from the bin and arranging the food items uniformly, and a device for receiving the arranged food items and accumulating the items into groups that are packed in containers. Typical of such systems are systems for packaging frankfurters.

Initially, cooked frankfurters are dumped into a large container. That container includes an opening near the bottom and a feed mechanism for depositing the frankfurters on a conveyer system. The conveyer system includes a plurality of belts positioned to receive the frankfurters and align them in an end-to-end orientation in a single line, or multiple lines of single frankfurters. The belts deposit the frankfurters onto a second belt having a plurality of transverse, raised ribs that receive the frankfurters and orient the frankfurters in a parallel orientation. The second belt deposits the frankfurters into a filler head where the frankfurters are collected into groups of several frankfurters (e.g., five frankfurters in a group) and the groups are then deposited into a receptacle having cavities corresponding to the size of the groups. The cavities are lined with plastic material that is used to package the groups of frankfurters for subsequent sale.

An example of such a filler head systems is shown in U.S. Pat. No. 5,893,259. That patent shows a filler head that receives cooked frankfurters from an input conveyer and collects the franks in a cage formed by individual rails. The frankfurters are retained in the cage by an index pusher. When a predetermined number of franks have been collected, the index pusher is cycled and conveys the franks onto staging area. The franks in the staging area are retained on spring loaded doors. Groups of franks are arranged in the staging area by an index lug chain. When a predetermined number of groups have been accumulated on the staging area, a ram is cycled to displace the groups downwardly through the spring loaded doors into a receptacle for packing.

A disadvantage with such systems is that a ram is required to displace food product items to the receptacle, which adds to the cost and shows the operation of the device. Accordingly, there is a need for a filler head system and method that maximizes the filling of the receptacle. There is also a need for an efficient system and method for rapidly filling a receptacle with multiple layers of food items such as frankfurters.

SUMMARY

The present invention is multi-layer food item loading system and method that overcomes the disadvantages of prior art systems and methods by providing an efficient and high-speed system and method for multi-layer food item loading into a receptacle. The method of the invention includes the steps of first collecting food items in a first plurality of groups, each of the groups having a plurality of food items, in a staging area, displacing the first plurality of groups substantially simultaneously downwardly into an accumulating and storage area, thereby forming a plurality of first-layer groups of the food items, collecting in the staging area a second plurality of groups of food items, each of the second plurality of groups having a plurality of food items, displacing the second plurality of groups substantially simultaneously downwardly into the accumulating and storage area such that the second plurality of groups forms a plurality of second layer groups of the food items superposed to the plurality of first layer groups of the food items, thereby forming a plurality of two layer groups of food items, and displacing substantially simultaneously the plurality of two layer groups of food items downwardly into a receptacle in a packing area. The advantage of the method of the present invention is that the presence of the accumulating and storage area allows multiple layers of food items to be collected before being displaced into the receptacle in the packing area. This allows higher reliability of product orientation in the receptacle in the packing area and also allows the step of displacing the multi-layer product into the receptacle to be performed substantially simultaneously with the accumulation of subsequent groups of product in the staging area.

Another advantage of the present invention is that the method utilizes a gravity feed that allows the groups to fall downwardly from the staging area to the accumulating and storage area by gravity and allows the multi-layer groups of product to be displaced by gravity downwardly into the receptacle. This eliminates the need for rams or other devices of prior art filler heads that add to the expense of the associated filler head and require that the accumulating equipment be stopped to allow cycling of the ram.

The system of the present invention includes a pair of sidewardly displaceable rods that support the food items in the staging area and in the accumulating and storage area. When the predetermined number of groups have been accumulated on the staging area by an index lug chain, the rods are cycled by being displaced outwardly to allow the groups of food product items to fall downwardly by gravity to the accumulating and storage area. The groups of food product items remain intact in the accumulating and storage area by dividers that are spaced accordingly. When a predetermined number of layers of food items have been collected in the accumulating and storage area, the rod supports in the accumulating and storage area are displaced sidewardly, allowing the multiple layers of food product to fall downwardly by gravity into the cavities of the receptacle.

The system of the invention also includes pairs of tucking flaps that cycle from a substantially vertical orientation to a substantially horizontal or below-horizontal orientation to maintain the desired arrangement of the food product items as they fall downwardly into the packing receptacle.

Other objects and advantages of the present invention will be apparent from the following description, the accompanying drawings and the appended claims.

DETAILED DESCRIPTION

Figure 1A:
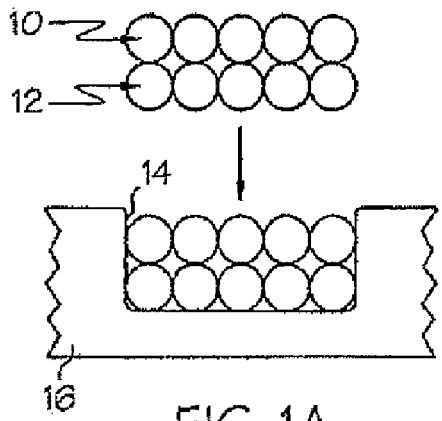
FIG. 1A is a schematic drawing of a detail of the loading system of the present invention showing two layers of food product items being displaced simultaneously into the cavity of a receptacle.
Figure 1B:
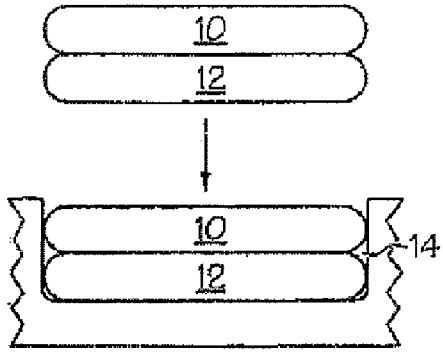
FIG. 1B is a side elevation of the schematic detail of FIG. 1A.
Figure 1C:
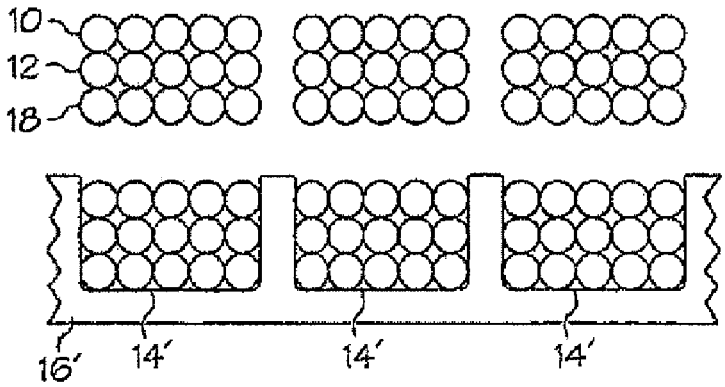
FIG. 1C shows schematically an alternate embodiment of the present invention in which three layers of food product items are loaded into a receptacle.

The multi-layer food item loading system of the present invention can accommodate a variety of food items of substantially consistent shape. However, the invention will be described with reference to food items such as frankfurters and the like. The invention is adapted to be retrofitted to a conventional frankfurter loading head or like device such as that shown and described in commonly-owned U.S. Pat. No. 5,893,259, the disclosure of which is incorporated herein by reference. Such loading heads or filler heads are used to receive cooked frankfurters or hot dogs from a conveyer, arrange them in groups and place them in receptacles for packaging. The benefit of the filler head of the present invention over the prior art, such as that shown in the aforementioned patent, is that, as shown schematically in FIGS. 1A and 1B, it loads multiple layers 10, 12 of frankfurters into a cavity 14 of a receptacle 16 substantially simultaneously. Also shown schematically in FIG. 1C, it is within the scope of the invention to provide a filler head that simultaneously loads three layers 10, 12, 18 of frankfurters into cavities 14' of receptacle 16'.

Figure 2:
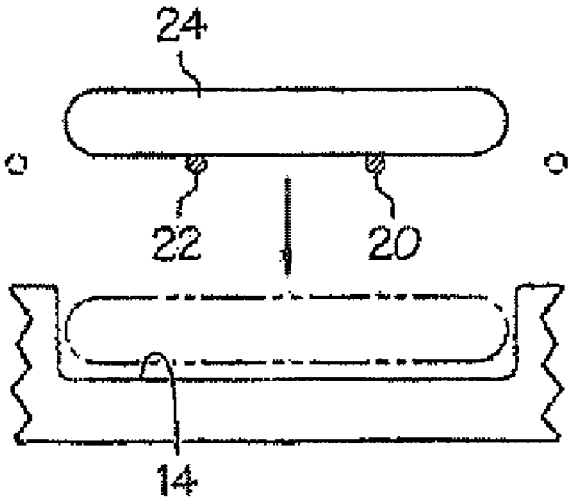
FIG. 2 is a schematic drawing showing of the present invention showing the action of the support rods of the accumulating and storage area.

Referring to FIG. 2, the filler head of the present invention includes support rods 20, 22 that support the frankfurters 24 above the cavity 14 until two layers of frankfurters (not shown) are collected. By allowing the frankfurters to fall by gravity, a ram or other mechanical means of prior art devices is not required to force the frankfurters downwardly into the receptacle 16, thereby eliminating interruptions caused by retraction of the ram. Sideward displacement of the support rods 20, 22 is preferred as it requires less cycle time than doors or flaps.

Figure 3:
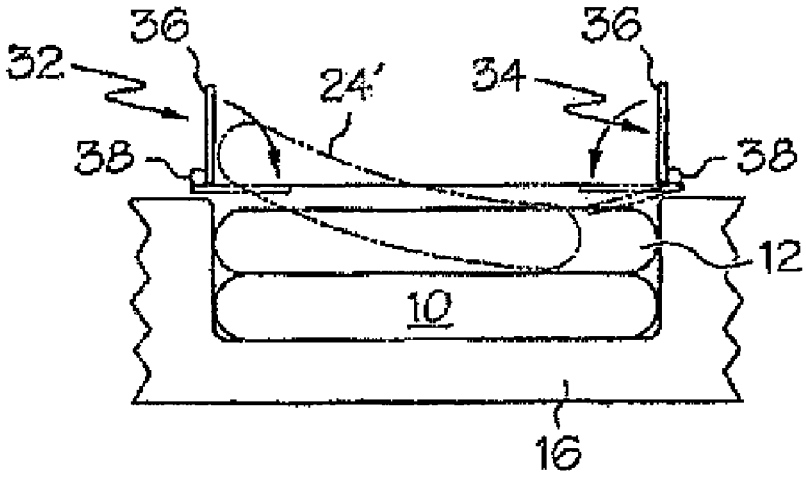
FIG. 3 is a schematic drawing showing the operation of the tucking flaps of the present invention.

As shown in FIG. 3, the filler head of the present invention also includes a pair of tucking flaps 32, 34 that are positioned above the receptacle 16. The tucking flaps 32, 34 are elongated panels attached to rods 38. The rods 38 are rotated about their longitudinal axes by a linear actuator, such as a hydraulic, pneumatic or electric actuator and linkage (not shown). Consequently, the flaps 32, 34 rotate between an open position, in which the flaps are oriented substantially vertically, and a closed position, in which the flaps are oriented substantially horizontally (shown in phantom in FIG. 3). Flaps 32, 34 are tiered to cycle over layers 10, 12 of frankfurters have passed in order to maintain the alignment of product shown. If, for example, a frankfurter 24' (shown in phantom) is out of alignment, when the tucking flaps 32,34 pivot they will bring the frankfurter into alignment.

Figure 4:
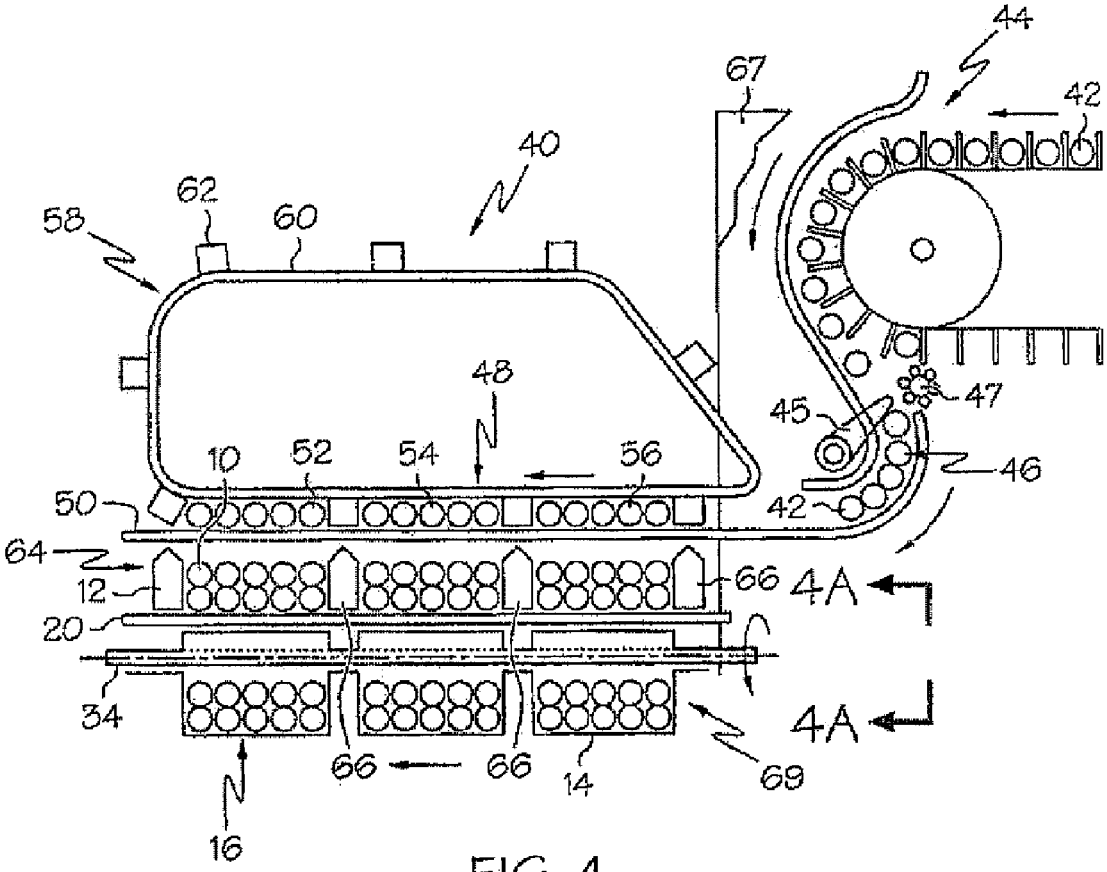
FIG. 4 is a schematic side elevation of the filler head of the present invention.
Figure 4A:
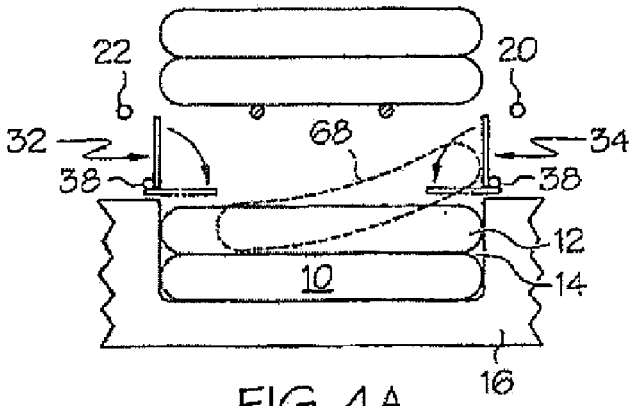
FIG. 4A is a detail of the filler head of FIG. 4 showing the operation of the tucking flaps and rods in the accumulating and storage area.

FIG. 4 shows a schematic of the filler head of the present invention, generally designated 40. The filler head 40 is adapted to receive frankfurters, generally designated 42, from a conventional conveyor system 44, such as that shown and described in the aforementioned U.S. Pat. No. 5,893,259. That conveyor system 44 includes a sweep arm 45 that collects groups 46 of five franks aided by sprocket stuffer shaft 47, then performs a complete rotation to move each group 46 to a staging area, generally designated 48. The staging area 48 consists of pairs of rods 50, 51 that are oriented parallel to each other and support groups 52, 54, 56 of accumulated frankfurters. The rods 50, 51 are actuated by a three-bar linkage (see FIG. 5) such that the rods reciprocate in a substantially horizontal direction from a support position (shown in FIG. 4) to a displaced position similar to that shown in FIG. 4A for rods 20, 22, in which the rods 50, 51 are separated sufficiently to allow the groups 52, 54, 56 to fall downwardly by gravity.

A powered lug chain system 58 includes a chain 60 having a plurality of lugs 62 that are spaced appropriately to collect the groups 46 of frankfurters displaced sidewardly by the sweep arm 44 to the staging area 48. Although the staging area 48 is shown in FIG. 4 as handling three discrete groups of frankfurters 52-56, as shown in FIG. 5, the staging area 48 includes two rows, each having discrete groups of frankfurters, and the conveyor system 44 feeds two frankfurters at a time to the staging area 48.

An accumulation and storage area 62 is located directly beneath the staging area 48 and includes a plurality of dividers 66 that are fixed to the filler head frame 67 and positioned to correspond to the spacing between the lugs 62 of the lug chain 60 and hence correspond to the width of groups 52, 54, 56 of frankfurters. The accumulation and storage area 64 also includes retractable rods 20, 22 (see FIGS. 2, 4A and 5) to support the collected frankfurters. The tucking flaps 32, 34 (See FIG. 3) are positioned below the rods and above the receptacle 16, located in a packing area 69.

Figure 5:
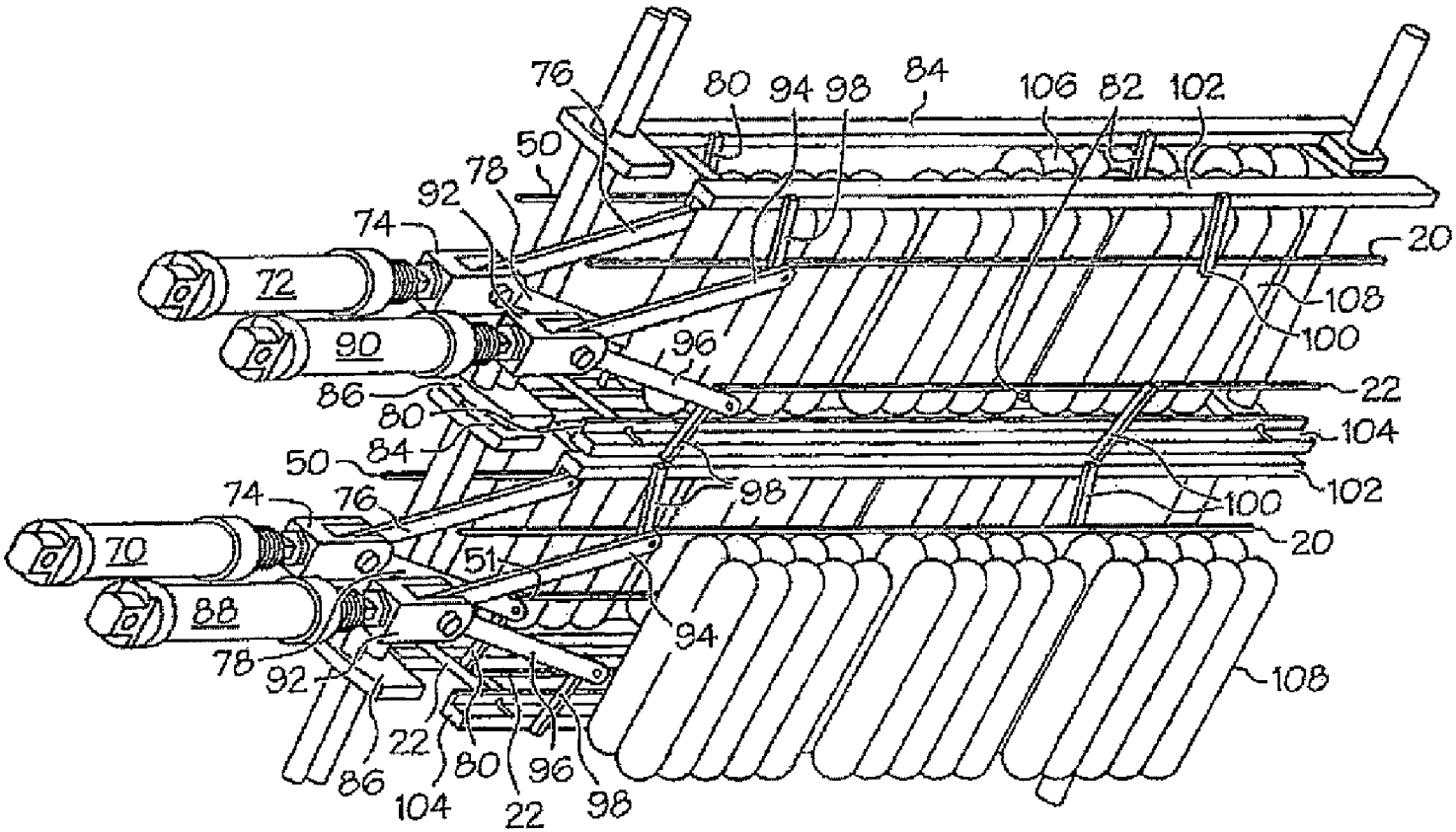
FIG. 5 is a perspective view of a detail of the filler head of FIG. 4 showing the operation of the support rods of the staging area and accumulating and storage area.

The structure and operation of the support rods of the present invention is shown in FIG. 5. Two cylinders 70, 72 are positioned in the staging area 48 and are each attached to a clevis 74 that is pivotally connected to link arms 76, 78 that, in turn, are pivotally attached to a pair of arms 80. Arms 80 and a pair arms 82 are each pivotally attached at one end to support bars 84, 86 (which are mounted on frame 67) and at an opposite end to rods 50, 51 that support frankfurters in the staging area 48. Similarly, in accumulation and storage area 64 cylinders 88, 90 each include a clevis 92 that is pivotally attached to link arms 94, 96 that, in turn, are attached to a pair of arms 98. Arms 98 and a pair of arms 100 are pivotally attached at one end to support bars 102, 104 (which are mounted on frame 67) and at an opposite end to rods 20, 22.

Consequently, actuation of cylinders 70, 72 draws devises 74 away from the frankfurters, thereby causing link arms 76, 78 to cause arms 80, 82 to pivot rods 50, 51 away from each other to allow frankfurter 106 to fall between the rods downwardly onto rods 20, 22 in the accumulation and storage area 64. Similarly, cylinders 88, 90 in the accumulation and storage area 64 are actuated to cause rods 20, 22 to move away from each other to allow a multi-layer of frankfurters 108 to fall downwardly into receptacle 16 (FIG. 4).

Figure 6:
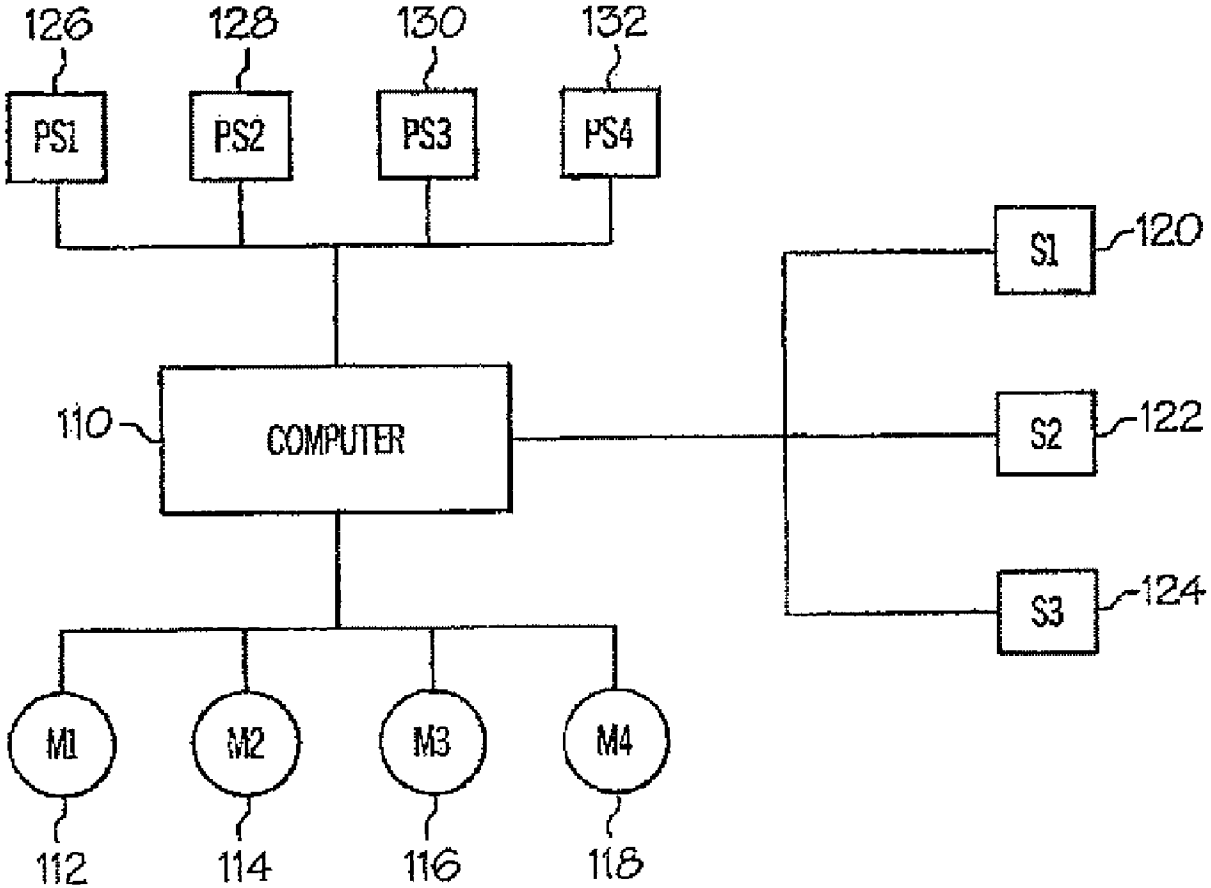
FIG. 6 is a schematic showing the computer control system of the present invention.

As shown in FIG. 6, the filler head 40 (see FIG. 4) preferably is operated by a computer 110. Computer 110 actuates servo motor M1 (112) that drives the input conveyor 44, servo motor M2 (114) that sweep arm 45, servo motor M3 (116) that operates index lug chain 58 and servo motor M4 (118) that rotates sprocket stuffer shaft 47. Computer 110 also actuates solonoid S1 (120) that operates cylinders 70, 72 in staging area 48, solonoid S2 (122) that controls cylinders 88, 90 in accumulation and storage area 64, and solonoid S3 (124) that actuates a cylinder (not shown) that actuates tucking flaps 32, 34.

Computer 110 also receives input signals from proximity switch PS1 (126) that indicates the initial position of the index lug chain 58, proximity switch PS2 (128) that detects the position of the input conveyer 44, proximity switch PS3 (130) that detects the position of the sweep arm 45 and proximity switch PS4 (132) that detects the position of the receptacle 16 in the packing area 69 (see FIG. 4). Alternatively, encoders built into servo motors 112-118 and communicating directly with the computer 110 could be used instead of proximity switches 126-132.

The operation of the loader head 40 shown in FIG. 4 is as follows, and is controlled by computer 110. Frankfurters 42 are delivered by the conveyor 44 where they are collected in groups 46 of five frankfurters each by sweep arm 44. Sweep arm 44 continuously cycles to displace groups 46 of frankfurters horizontally along rods 50, 51 in the staging area 48, where the groups 46 are displaced by the index lug chain 58 along the rods in groups 52, 54, 56 of five items, directly above the cavities 14 of the receptacle 16. Once the groups 52,54, 56 of frankfurters are positioned as shown in FIG. 4, the pairs of rods 50, 51 are cycled by computer 110, during which the cylinders 70, 72 displace them sidewardly sufficiently to allow the collected groups 52, 54, 56 to fall downwardly by gravity to pairs of rods 20, 22. This process takes place at least twice so that two at least two layers 10, 12 of groups of frankfurters are collected in the accumulation and storage area 64 between dividers 66.

Once at least two layers 10, 12 of groups of frankfurters are collected in the accumulation and storage area 64, rods 20, 22 are displaced sidewardly by cylinders 88,90 activated by computer 110, allowing the two layers 10, 12 to fall downwardly substantially simultaneously by gravity to the packing area 69. At this point in time, tucking flaps, 32, 34 are oriented vertically so that the two layers 10, 12 of frankfurters of the groups fall downwardly by gravity substantially simultaneously into cavities 14. Once the frankfurters have fallen below the flaps 32, 34, the flaps are actuated to the closed position (shown in phantom in FIG. 4A). This action by the flaps helps to align the frankfurters in substantially parallel orientation by pressing downwardly on any misaligned frankfurters 68 that may be present (shown in phantom).

The operation of the filler head 40 is substantially continuous. However the lug chain 58 operates intermittently, pausing momentarily when groups 52, 54, 56 are positioned as shown in FIG. 4 in order to allow for the pairs of rods 50, 51 to by cycled to allow the group 52-56 of frankfurters to fall downwardly into the accumulation and storage area 64.

What is claimed is:

1. A method of loading a plurality of food items in multiple layers comprising the steps of:

collecting food items in a first plurality of groups, wherein each group is separated from the other by a divider, each of said groups having a plurality of food items, in a staging area;

displacing said first plurality of groups substantially simultaneously downwardly into an accumulating and storage area, thereby forming a plurality of first layer groups of said food items therein, wherein each group is separated from the other by a divider;

collecting in said staging area a second plurality of said groups of food items, each of said second plurality of said groups having a plurality of food items;

displacing said second plurality of groups substantially simultaneously downwardly into said accumulating and storage area such that said second plurality of groups forms a plurality of second layer groups of said food items superposed to said plurality of first layer groups of said food items, thereby forming a plurality of two layer groups of food items; and displacing substantially simultaneously said plurality of two-layer groups of food items downwardly into a plurality of receptacles in a packing area, wherein each receptacle corresponds to one of said two layer groups.

2. The method of claim 1 wherein said step of displacing said first plurality of groups includes the step of allowing said first plurality of groups to fall by gravity into said accumulating and storage area.

3. The method of claim 1 wherein said step of displacing said second plurality of groups includes the step of allowing said first plurality of groups to fall by gravity into said accumulating and storage area.

4. The method of claim 1 wherein said step of displacing said plurality of two-layer groups includes the step of allowing said plurality of two-layer groups to fall by gravity into said receptacle.

5. The method of claim 1 wherein said step of displacing said plurality of two-layer groups includes the step of substantially simultaneously performing a subsequent step of collecting food items in a first plurality of groups, each of said groups having a plurality of food items, in said staging area.

6. The method of claim 1 further comprising the step of displacing said receptacle containing said plurality of two-layer groups of food items from said packing area.

7. The method of claim 6 further comprising the step of placing a second receptacle in said packing area.

8. A method of loading food items in multiple layers comprising the steps of:

collecting food items in a first plurality of groups, wherein each group is separated from the other by a divider, each of said groups having a plurality of food items, in a staging area;

displacing said first plurality of groups by allowing said first plurality of groups to fall by gravity substantially simultaneously downwardly into an accumulating and storage area, thereby forming a plurality of first layer groups of said food items therein, wherein each group is separated from the other by a divider;

collecting in said staging area a second plurality of said groups of food items, each of said second plurality of said groups having a plurality of food items;

displacing said second plurality of groups by allowing said second plurality of groups to fall by gravity substantially simultaneously downwardly into said accumulating and storage area such that said second plurality of groups forms a plurality of second layer groups of said food items superposed to said plurality of first layer groups of said food items, thereby forming a plurality of two layer-groups of food items; and displacing substantially simultaneously said plurality of two-layer groups of food items downwardly by gravity into a plurality of receptacles in a packing area, wherein each receptacle corresponds to one of said two layer groups.

9. A method of loading food items in multiple layers comprising the steps of:

collecting food items in a first plurality of groups, wherein each group is separated from the other by a divider, each of said groups having a plurality of food items, in a staging area;

displacing said first plurality of groups by allowing said first plurality of groups to fall by gravity substantially simultaneously downwardly into an accumulating and storage area, thereby forming a plurality of first layer groups of said food items therein, wherein each group is separated from the other by a divider;

collecting in said staging area a second plurality of said groups of food items, each of said second plurality of said groups having a plurality of food items;

displacing said second plurality of groups by allowing said second plurality of groups to fall by gravity substantially simultaneously downwardly into said accumulating and storage area such that said second plurality of groups forms a plurality of second layer groups of said food items superposed to said plurality of first layer groups of said food items, thereby forming a plurality of two layer-groups of food items; and displacing substantially simultaneously said plurality of two-layer groups of food items downwardly by gravity into a plurality of receptacles in a packing area and substantially simultaneously performing a subsequent step of collecting food items in a first plurality of groups, each of said groups having a plurality of food items, wherein each receptacle corresponds to one of said two layer groups, in said staging area.

* * * * *